US005344348A

United States Patent [19]

Willis et al.

[11] Patent Number: 5,344,348

[45] Date of Patent: Sep. 6, 1994

[54] ELECTRICAL TERMINAL

[75] Inventors: Lowell R. Willis, Carsonville; Douglas A. Particka, Snover; George J. Tilli, Algonac, all of Mich.

[73] Assignee: Clements Manufacturing Company, Inc., Deckerville, Mich.

[21] Appl. No.: 54,904

[22] Filed: Apr. 29, 1993

[51] Int. Cl.[5] ..... H01R 11/22

[52] U.S. Cl. ..... 439/849; 439/881

[58] Field of Search ..... 439/834, 845, 848, 849, 439/850, 852, 858, 861, 862, 881

[56] References Cited

U.S. PATENT DOCUMENTS

| | | | |
|---|---|---|---|
| 2,945,206 | 7/1960 | Hammell | 439/881 |
| 3,076,171 | 1/1963 | Hopkins | 439/849 |
| 3,096,136 | 7/1963 | Batcheller | 439/881 |
| 3,123,431 | 3/1964 | Keller | 439/881 |
| 4,415,221 | 11/1983 | Inoue et al. | 439/849 |
| 4,579,409 | 4/1986 | Enneper et al. | 439/845 |
| 4,685,754 | 8/1987 | Coldren . | |
| 5,181,866 | 1/1993 | Jerome et al. . | |

*Primary Examiner*—Eugene F. Desmond

*Attorney, Agent, or Firm*—Harness, Dickey & Pierce

[57] ABSTRACT

An electrical connector has a generally closed rectangular receptacle for receiving a tab. The rectangular receptacle is formed without an opening along any of its sides in order to maintain the integrity of the rectangular receptacle during numerous insertions and withdrawals of the tab. A tongue is provided within the receptacle to aid in the retention of the tab as well as insuring electrical contact between the two members. A pair of locking projections are also provided within the receptacle. The locking projections are designed to deflect during the insertion of the tab and to spring into a corresponding pair of recesses in the tab to aid in the retention of the tab within the receptacle.

17 Claims, 2 Drawing Sheets

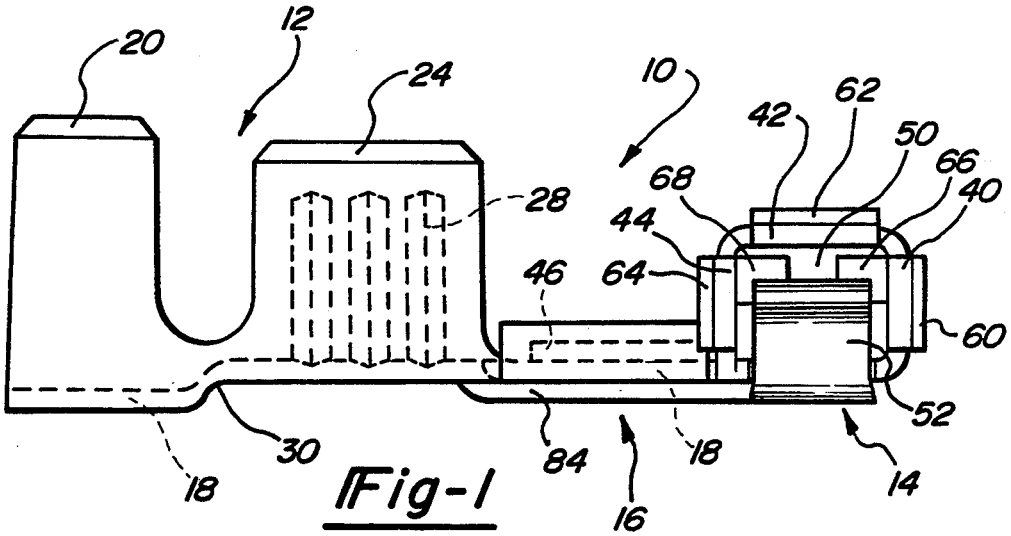
Fig-1
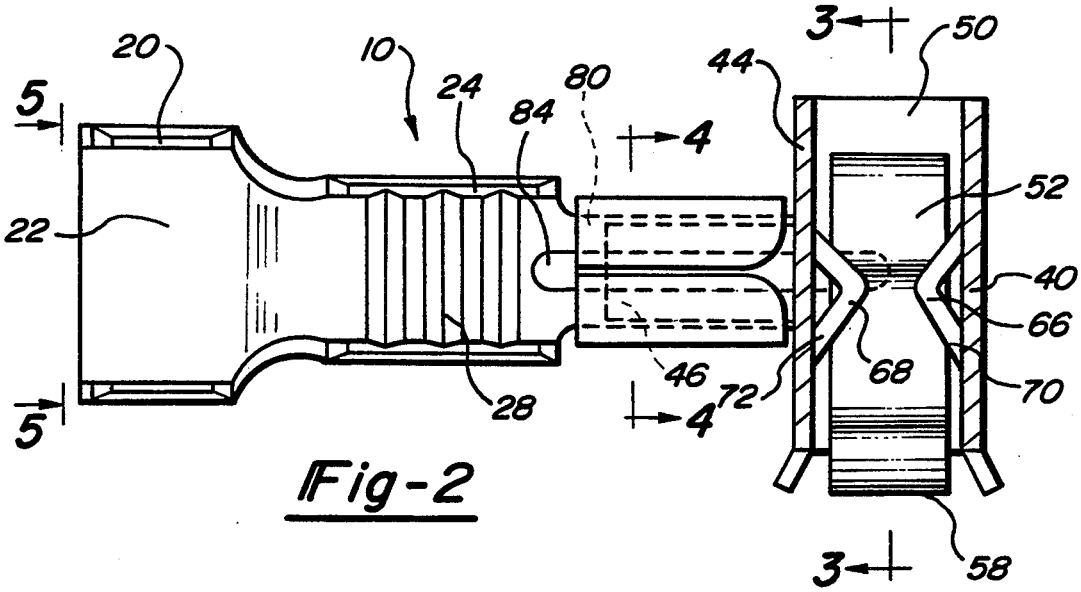
Fig-2
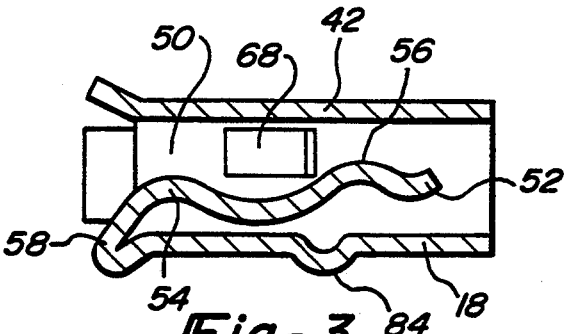
Fig-3
Fig-4
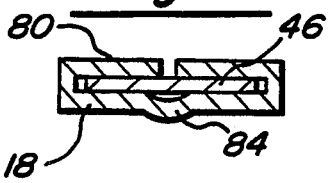

ELECTRICAL TERMINAL

FIELD OF THE INVENTION

The present invention relates to a stamped metal female electrical receptacle. More particularly, the present invention relates to a stamped metal female electrical receptacle which forms a closed rectangular box which significantly increases the strength and durability of the female receptacle.

BACKGROUND OF THE INVENTION

Stamped metal female tab receiving electrical receptacles have become widely accepted and utilized, particularly in the automobile industry, where a positive latching characteristic is required for reliability of operation. A typical prior art female receptacle is stamped and formed from sheet metal and comprises a generally channel shaped receptacle portion having a base and upstanding side walls with the free edge of the sidewalls being bent towards each other to overlie the base to form the channel shaped receptacle. Some of the prior art designs include a lock and/or a tongue which is struck out from the base to extend rearwardly within the receptacle portion from a front root end to aid in the retention of the male tab. In still other prior art designs, the tongue is not struck out from the base but extends initially from a forward edge of the base and is then bent back to extend rearwardly within the receptacle.

While the prior art female receptacles have performed satisfactorily, reliability problems have been experienced with this kind of terminal which relies predominantly on the flexural characteristics of the tongue, if present, along with the flexural characteristics of the upstanding sidewalls to obtain the retention loads. With continued insertion and withdrawal of the tab, the holding integrity of the female receptacle degrades due to the plastic deformation of either the tongue or the sidewalls. Particularly, the sidewalls will have a tendency to open up and increase the size of the receptacle which then leads to lower retention loads. In addition, the plastic deformation can lead to loosening of the tab within the receptacle which may cause intermittent electrical connection between the two pieces, especially when the connection is subjected to vibration.

Accordingly, what is needed is a stamped metal female receptacle which will retain its retention characteristics after multiple insertion and withdrawals of the male tab.

SUMMARY OF THE INVENTION

The present invention provides the art with a stamped metal tab receiving female receptacle which forms a closed box which defines the receptacle. The free end of the material forming the receptacle is folded back onto the parent material and then secured to the parent material to maintain the integrity of the formed receptacle and thus maintain both the insertion and withdrawal loads.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 1 is a side elevational view of the electrical terminal according to the present invention;

FIG. 2 is a plan view, partially in cross section of the electrical terminal shown in FIG. 1;

FIG. 3 is a sectional view taken in the direction of arrows 3—3 of FIG. 2;

FIG. 4 is a sectional view taken in the direction of arrows 4—4 of FIG. 2;

DESCRIPTION OF THE PREFERRED EMBODIMENT

Figure 5:
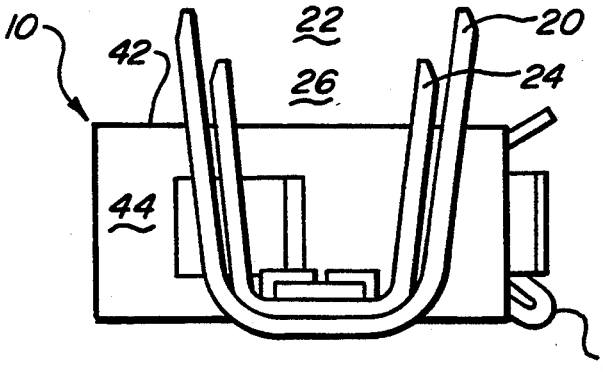
FIG. 5 is an end elevational view of the electrical terminal shown in FIG. 1.

Referring now to the drawings in which like reference numerals designate like or corresponding parts throughout the several views, there is shown in FIGS. 1 through 5 an electrical connector according to the present invention which is designated generally by reference numeral 10. Connector 10 is made from a single piece of stamped metal, preferably brass approximately 0.010 inches thick, and is comprised generally of three sections, a wire retaining section 12, a receptacle section and a retention section 16 disposed between wire retaining section 12 and receptacle section 14. A base 18 is common to and forms the supporting member for wire retaining section 12, retention section 16 and receptacle section 14.

Wire retaining section 12 is adapted to secure an appropriate lead wire (not shown) by crimping onto both a bare wire portion of the lead wire as well as an insulated portion of the lead wire. A first pair of wings 20 extend from base 18 and are bent generally vertical to base 18 to form a generally U-shaped receptacle 22 for accepting the insulated portion of the lead wire. After placement of the insulated portion of the wire within the U-shaped receptacle 22 formed by wings 20, wings 20 are crimped over on top of base 18 by an appropriate tool to retain the insulated portion of the lead wire by sandwiching the insulated portion of the lead wire between base 18 and wings 20. In a similar manner, a second pair of wings 24 extend from base 18 spaced from wings 20 and are bent generally vertical to base 18 to form a generally U-shaped receptacle 26 for accepting the bare wire portion of the lead wire extending from the insulated portion of the lead wire retained by wings 20. A plurality of ribs 28 are formed into wings 24 and base 18 in the area of wings 24 to enhance both the contact with and the retention of the bare wire portion of the lead wire. After placement of the bare wire portion of the lead wire within the U-shaped receptacle 26 formed by wings 24, wings 24 are crimped over on top of base 18 by an appropriate tool to retain the bare wire portion of the lead wire by sandwiching the bare wire portion of the lead wire between base 18 and wings 24. During the crimping operation, ribs 28 are crimped into the bare wire portion of the lead wire. A stepped section 30 is formed in base 18 between wings 20 and 24 to accommodate the thickness of the insulation in order to present a generally conforming surface on base 18 for the lead wire to contact.

Base 18 extends from wire retaining section 12 through retention section 16 to form the base of receptacle section 14. Base 18 is folded at its end opposite to wire retaining section 12 generally perpendicular to base 18 to form end wall 40. End wall 40 continues upward generally perpendicular to base 18 and is folded over generally perpendicular to end wall 40 to form upper wall 42. Upper wall 42 is generally parallel to base 18 and end wall 40 is folded in such a manner that upper wall 42 is disposed above base 18. Upper wall 42 continues generally parallel to base 18 and is folded over generally perpendicular to upper wall 42 in a direction back towards base 18 to form sidewall 44. Sidewall 44 is thus generally parallel to end wall 40 and spaced from end wall 40 by both base 18 and upper wall 42. Sidewall 44 continues generally perpendicular to upper wall 42 towards base 18 and is folded over generally perpendicular to sidewall 44 to form a retaining tab 46. Retaining tab 46 is thus generally parallel to base 18 and extends from sidewall 44 of receptacle section 14 into retention section 16 as will be described later herein. Thus, a rectangular tab receptacle 50 is formed by base 18, end wall 40, upper wall 42 and sidewall 44.

A tongue 52 initially extends from the section of base 18 which forms receptacle 50 and is then bent back to extend rearwardly within receptacle 50. Tongue 52 is an arcuately shaped member having a pair of ribs 54 and 56 to aid in both the retention properties and the electrical interfacing of connector 10. Tongue 52 is angled generally upward within receptacle 50 such that tongue 52 will be deflected downward upon the insertion of the tab to provide a portion of the retaining load and enhance the electrical contact between connector 10 and the inserted tab. The bent portion 58 of tongue 52 protrudes forwardly of walls 40, 42 and 44 of receptacle 50 to form a ramp which aids in the insertion of the tab into receptacle 50 by acting as a guiding surface for the tab.

Walls 40, 42 and 44 each have a guiding tab 60, 62 and 64 respectively which extend from receptacle 50 in a manner similar to that of bent portion 58. Guiding tabs 60, 62 and 64 each form a ramp which aids in the insertion of the tab into receptacle 50 by acting as a guiding surface for the tab.

Walls 40 and 44 each have a locking projection 66 and 68 respectively which are struck out from their respective sides and extend into receptacle 50 from a front root end 70 and 72 integral with their respective side wall at a location in transverse alignment with the leading edge of their respective sidewall to a rear root end angled back toward their respective sidewall as shown in FIG. 2. Locking projections 66 and 68 are designed to be deflected outward during the insertion of the tab such that they spring back into a recessed area located on the tab to aid in the retention of the tab within receptacle 50 as will be described later herein.

Retention section 16 comprises base 18 and retaining tab 46 as well as a pair of wings 80 extending from base 18. Retaining tab 46 is created by the folding of sidewall 44 as described above and extends from sidewall 44 generally parallel and adjacent to base 18. Upon the completion of the folding operation which creates retaining tab 46, wings 80, which initially extend from base 18, are crimped over on top of base 18 by an appropriate tool to retain tab 46 by sandwiching tab 46 between base 18 and wings 80. Thus, the crimping of wings 80 secures tab 46 and closes rectangular receptacle 50 such that receptacle 50 does not have a free end which could open during continuous insertion and withdrawal of the tab. In addition, the combination of base 18, tab 46 and wings 80 creates a strengthened grip transition area within retention section 16 by having a triple layered construction to resist deformation. A rib 84 is formed into base 18 and extends from wire retaining section 12, through retention section 16 and into receptacle section 14 to provide additional bending and distortion resistance to base 18.

Figure 6:
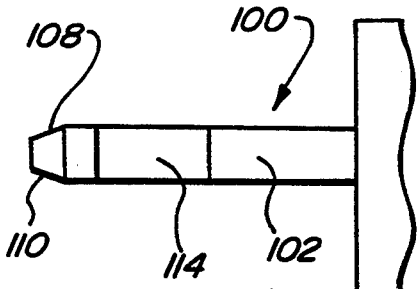
FIG. 6 is a side elevational view of a typical male tab for mating with the female receptacle of the present invention.
Figure 7:
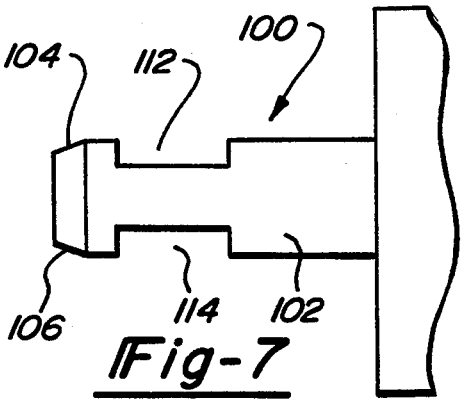
FIG. 7 is a plan view of the male tab shown in FIG. 6.

A typical tab for insertion into and mating with connector 10 is shown in FIGS. 6 and 7 and is designated generally as reference numeral 100. Tab 100 comprises a generally flat rectangular body 102 having a first pair of chamfers 104 and 106 located on one pair of side surfaces of body 102 and a second pair of chamfers 108 and 110 located on the other pair of side surfaces of body 102. A pair of recesses 112 and 114 are formed into body 102 to cooperate with locking projections 66 and 68 in order to retain tab 100 within connector 10 as described above.

Assembly of connector 10 with tab 100 begins with tab 100 being inserted into the receiving end of receptacle 50. Bent portion 58, guiding tab 60, guiding tab 62 and guiding tab 64 of receptacle 50 cooperate with chamfer 104, chamfer 106, chamfer 108 and chamfer 110 to align tab 100 with receptacle 50. Tab 100 is then inserted into receptacle 50 deflecting tongue 52, locking projection 66 and locking projection 68. Continued movement of tab 100 into receptacle 50 will eventually align locking projections 66 and 68 with recesses 112 and 114 and locking projections 66 and 68 will spring into slots 112 and 114 to resist the withdrawal of tab 100 from receptacle 50. During continuous insertion and withdrawals of tab 100 with receptacle 50, receptacle 50 will retain its original size and shape due to the retention of tab 46 by wings 80 of retention section 16. In addition, the 360° closed box design of receptacle 50 resists deformation due to the rotational loads exerted between connector 10 and tab 100. These rotational loads are one of the causes of plastic deformation of prior art receptacles.

Figure 8:
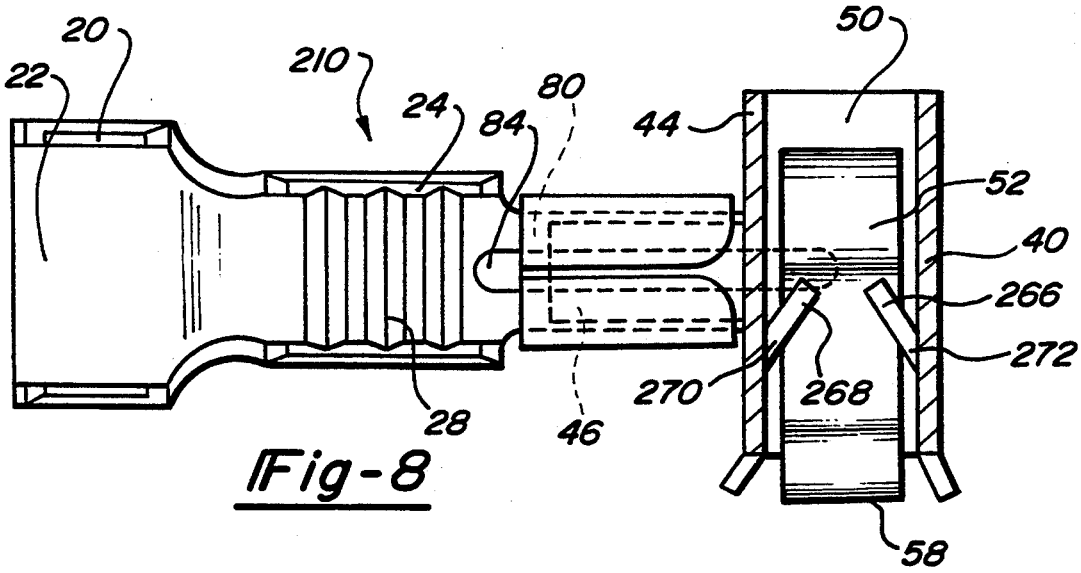
FIG. 8 is a view similar to that shown in FIG. 2 showing an electrical connector according to another embodiment of the present invention.

Referring now to FIG. 8, an electrical connector 210 is shown in accordance with another embodiment of the present invention. Connector 210 is similar to connector 10 with the exception of the locking projections 66 and 68. Walls 40 and 44 of connector 210 each have a locking projection 266 and 268 respectively which are struck out from their respective sides and extend rearwardly within receptacle 50 from a front root end 270 and 272 integral with their respective sidewall at a location in transverse alignment with the leading edge of their respective sidewall to a rear free end extending into receptacle 50. Locking projections 266 and 268 are designed to be deflected outward during the insertion of the tab such that they spring back into the recessed area located on the tab to retain the tab within receptacle 50 similar to the description above for connector 10 with the exception that locking projections 266 and 268 are designed not to allow withdrawal of the tab from receptacle 50. The operation and function of connector 210 is the same as that described above for connector 10 with the exception of the permanent retention of the tab.

While the above detailed description describes the preferred embodiment of the present invention, it should be understood that the present invention is susceptible to modification, variation and alteration without deviating from the scope and fair meaning of the subjoined claims.

What is claimed is:

1. A female electrical connector comprising:

a base having a first end, a second end and defining a first longitudinal axis, said base forming a generally closed rectangular receptacle at said first end, said receptacle defining a second longitudinal axis, said second longitudinal axis being generally perpendicular to said first longitudinal axis;

a retention tab integral with said closed rectangular receptacle, said retention tab extending from said closed rectangular receptacle running along said base towards said second end of said base generally parallel to said first longitudinal axis; and means for securing said retention tab to said base such that the integrity of said closed rectangular receptacle is maintained.

2. The female electrical connector of claim 1 further comprising means for securing a lead wire to said second end of said base.

3. The female electrical connector of claim 2 wherein said means for securing said lead wire includes at least one wing integral with said base, said at least one wing being formed to sandwich a bare wire section of said lead wire between said at least one wing and said base.

4. The female electrical connector of claim 3 wherein said means for securing said lead wire includes a second wing integral with said base, said second wing being formed to sandwich an insulated wire section of said lead wire between said second wing and said base.

5. The female electrical connector of claim 1 wherein said means for securing said retention tab comprises at least one wing integral with said base, said at least one wing being formed to sandwich said retention tab between said at least one wing and said base.

6. The female electrical connector of claim 1 further comprising a tongue integral with said base and extending generally parallel to said second longitudinal axis into said closed rectangular receptacle from an open end of said closed rectangular receptacle, said tongue being deflected when a male electrical connector is inserted into said open end of said closed rectangular receptacle.

7. The female connector of claim 6 wherein said tongue forms a ramp at said open end of said closed rectangular receptacle for guiding a male electrical connector into said open end of said closed rectangular receptacle.

8. The female electrical receptacle of claim 1 further comprising at least one locking projection extending from a wall of said closed rectangular receptacle into said closed rectangular receptacle for latching engagement in a recess formed in a male electrical connector inserted into said closed rectangular receptacle.

9. The female electrical receptacle of claim 8 wherein said at least one locking projection has a free end extending into said closed rectangular receptacle for locking engagement into said recess.

10. The female connector of claim 1 further comprising at least one ramp integral with said base and extending from an open end of said closed rectangular receptacle for guiding a male electrical connector into said open end of said closed rectangular receptacle.

11. A female electrical connector comprising:

a base having a first end, a second end and defining a first longitudinal axis, said base forming a generally closed rectangular receptacle having an open end, said generally closed rectangular receptacle being disposed at said first end of said base and defining a second longitudinal axis, said second longitudinal axis being generally perpendicular to said first longitudinal axis;

a retention tab integral with said closed rectangular receptacle, said retention tab extending from said closed rectangular receptacle running along said base towards said second end of said base generally parallel to said first longitudinal axis;

at least one wing integral with said base, said at least one wing being formed to sandwich said retention tab between said at least one wing and said base;

a tongue integral with said base and extending generally parallel to said second longitudinal axis into said closed rectangular receptacle from said open end of said closed rectangular receptacle, said tongue deflecting when a male electrical connector is inserted into said open end of said closed rectangular receptacle; and at least one locking projection extending from a wall of said closed rectangular receptacle into said closed rectangular receptacle for latching engagement in a recess formed in said male connector when said male connector is inserted into said open end of said closed rectangular receptacle.

12. The female electrical connector of claim 11 further comprising means for securing a lead wire to said second end of said base.

13. The female electrical connector of claim 12 wherein said means for securing said lead wire includes a second wing integral with said base, said second wing being formed to sandwich a bare wire section of said lead wire between said second wing and said base.

14. The female electrical connector of claim 13 wherein said means for securing said lead wire includes a third wing integral with said base, said third wing being formed to sandwich an insulated wire section of said lead wire between said third wing and said base.

15. The female connector of claim 11 wherein said tongue forms a ramp at said open end of said closed rectangular receptacle for guiding said male electrical connector into said open end of said closed rectangular receptacle.

16. The female connector of claim 11 further comprising at least one ramp integral with said base and extending from said open end of said closed rectangular receptacle for guiding said male electrical connector into said open end of said closed rectangular receptacle.

17. The female electrical receptacle of claim 11 wherein said at least one locking projection has a free end extending into said closed rectangular receptacle for locking engagement into said recess.

* * * * *